US005637160A

United States Patent [19]

Brock et al.

[11] Patent Number: 5,637,160

[45] Date of Patent: Jun. 10, 1997

[54] CORROSION-RESISTANT BISMUTH BRASS

[75] Inventors: Andrew J. Brock, Cheshire; John F. Breedis, Trumbull; Jack Crane, Woodbridge; Julius C. Fister, Hamden; Frank N. Mandigo, North Branford, all of Conn.; David D. McDevitt, Greenwood; Mark N. Pearman, Carmel, both of Ind.; Ronald N. Caron, Branford, Conn.

[73] Assignee: Olin Corporation, New Haven, Conn.

[21] Appl. No.: 277,928

[22] Filed: Jul. 20, 1994

Related U.S. Application Data

[60] Continuation-in-part of Ser. No. 155,680, Nov. 22, 1993, Pat. No. 5,409,552, which is a division of Ser. No. 907,473, Jul. 1, 1992, Pat. No. 5,288,458, which is a continuation-in-part of Ser. No. 662,876, Mar. 1, 1991, Pat. No. 5,137,685.

[51] Int. Cl.[6] ..... C22C 9/04

[52] U.S. Cl. ..... 148/434; 148/412; 148/413; 148/432; 148/433; 148/442; 420/472; 420/476; 420/477; 420/499; 420/587; 420/589

[58] Field of Search ..... 420/472, 476, 420/477, 499, 587, 589; 148/412, 413, 432, 433, 434, 442

[56] References Cited

U.S. PATENT DOCUMENTS

| | | | |
|---|---|---|---|
| 1,959,509 | 5/1934 | Tour et al. | 420/481 |
| 4,180,398 | 12/1979 | Parikh | 420/484 |
| 4,879,094 | 11/1989 | Ruston | 420/476 |
| 5,167,726 | 12/1992 | LoIacono et al. | 148/434 |
| 5,262,124 | 11/1993 | Yamaji et al. | 420/477 |

FOREIGN PATENT DOCUMENTS

| | | | |
|---|---|---|---|
| 0457478 | 11/1991 | European Pat. Off. | 148/432 |
| 54-135618 | 10/1979 | Japan . | |
| 55-97443 | 7/1980 | Japan . | |

OTHER PUBLICATIONS

"Low Melting Point Inclusions and Hot Tearing in Brass Castings" by Oya et al. Report of the Casting Research Laboratory, Waseda University. No. 30 (1979), pp. 93–100.

"Free–Cutting Copper Alloys Contain No Lead" by John T. Plewes and Dominic N. LoIacono, appearing in Advanced Materials & Processes Oct. 1991 at pp. 23–27.

"Bismuth—Its Effect on the Hot–Working and Cold–working Properties of Alpha and Alpha–beta Brasses" by William B. Price and Ralph W. Bailey. Trans. (Feb. 1942) at pp. 136–143, AIME.

"Bismuth in Copper and Copper Base Alloys" by D.W. Davies. Aug. 1993 (a literature review).

*Primary Examiner*—David A. Simmons
*Assistant Examiner*—Robert R. Koehler
*Attorney, Agent, or Firm*—Gregory S. Rosenblatt

[57] ABSTRACT

There is provided a machinable α+β brass containing bismuth and phosphorous. By maintaining the phosphorous content within a critical range, the alloy exhibits good elevated temperature tensile elongation in the temperature range of 100° C.–350° C. without a decrease in machinability due to phosphide formation. In preferred embodiments, the alloy further contains a tin addition for enhanced corrosion resistance. The combination of tin and phosphorous provides enhanced corrosion resistance to the alloy than could be predicted from either addition alone.

23 Claims, 7 Drawing Sheets

CORROSION-RESISTANT BISMUTH BRASS

CROSS-REFERENCE TO RELATED APPLICATIONS

This application is a continuation-in-part of U.S. patent application Ser. No. 08/155,680 now U.S. Pat. No. 5,409,522 by David D. McDevitt et al, filed Nov. 22, 1993 which is a division of U.S. Pat. No. 5,288,458 by David D. McDevitt et al, Ser. No. 907,473, filed Jul. 1, 1992 which in turn is a continuation-in-part of U.S. Pat. No. 5,137,685 Ser. No. 662,876, filed Mar. 1, 1991 by David D. McDevitt et al (with Reexamination Certificate date Sep. 26, 1995).

BACKGROUND OF THE INVENTION

1. Field of the Invention

This patent application relates to a reduced lead brass alloy that is both machinable and corrosion resistant. More particularly, an α+β brass containing bismuth and phosphorous, as well as, optionally tin is claimed. Within specific composition limits, these additions improve machinability and corrosion resistance without a detrimental effect on machinability.

2. Background

Free machining copper alloys contain lead or other additions to facilitate chip formation and the removal of metal in response to mechanical deformation caused by penetration of a cutting tool.

The addition to the alloy is selected to be insoluble in the copper based matrix. As the alloy is cast and processed, the addition collects both at boundaries between crystalline grains and within the grains. The addition improves machinability by enhancing chip fracture and by providing lubricity to minimize cutting force and tool wear.

Brass, a copper-zinc alloy, is made more machinable by the addition of lead. One example of a leaded brass is alloy C360 (nominal composition, 61.5% copper, 35.5% zinc and 3% lead). Throughout this patent application, all alloy compositions are in weight percent unless otherwise indicated. Alloy C360 has high machinability and acceptable corrosion resistance. Alloy C360 is commonly used in environments where exposure to water is likely. Typical applications include plumbing fixtures for potable water.

The ingestion of lead is harmful to humans, particularly children with developing neural systems. To reduce the risk of exposure, lead has been removed from the pigments of paints. It has now been proposed in the United States Senate to reduce the concentration of lead in plumbing fittings and fixtures to a concentration of less than 2% lead by dry weight. There is, accordingly, a need to develop machinable copper alloys, particularly brasses, which meet the reduced lead target.

One such alloy is disclosed in U.S. Pat. No. 4,879,094 to Rushton. The patent discloses a cast copper alloy which is substantially lead free. The alloy contains, by weight, 1.5–7% bismuth, 5–15% zinc, 1–12% tin and the balance copper. The alloy is free machining and suitable for use with potable water. However, the alloy must be cast and is not wrought.

A wrought alloy is desirable since the alloy may be extruded or otherwise mechanically formed into shape. It is not necessary to cast objects to a near net shape. Wrought alloy feed stock is more amenable to high speed manufacturing techniques and generally has lower associated fabrication costs than cast alloys.

Another free machining brass is disclosed in Japanese Patent Application 54–135618. The publication discloses a copper alloy having 0.5–1.5% bismuth, 58–65% copper and the balance zinc. The replacement of lead with bismuth at levels up to 1.5% will not provide an alloy having machinability equivalent to that of alloy C360.

Wrought bismuth containing copper alloys are disclosed in U.S. Pat. No. 5,167,726 to LoIacono et al. The alloy contains in excess of 0.1% phosphorous, 0.25% indium and/or 0.5% tin to reduce embrittlement of the copper alloy caused by the bismuth addition. As the phosphorous content is increased, phosphides form in the alloy. These phosphides are significantly harder than the copper base alloy and cause excessive wear to machining tools.

Phosphorous is also disclosed to increase the hot tearing of a bismuth containing brass casting in an article by Oya et al. entitled "Low Melting Point Inclusions and Hot Tearing in Brass Castings". An article by Price entitled "Bismuth—Its Effect on the Hot-working and Cold-working Properties of Alpha and Alpha-beta Brasses" discloses that the addition of 0.01%–0.02% phosphorous eliminated fire cracking in a 70% copper–30% zinc alloy (α brass) containing 1% bismuth.

Fire-cracking is the formation of cracks when a cold worked alloy is heated rapidly to above the recrystallization temperature. According to the Price article, the presence of internal stresses due to working the alloy followed by the sudden application of heat causes fire-cracking.

The presence of β phase in a bismuth containing brass greatly improves the hot working capability of the alloy. However, when the alloy is used for water transport or water storage, the β phase is susceptible to corrosion. There exists, therefore, a need for a bismuth containing copper alloy that is resistant to fire-cracking and corrosion and also has good machinability.

SUMMARY OF THE INVENTION

Accordingly, it is an object of the invention to provide a bismuth containing brass that is either lead free or has a reduced lead content. Another object of the invention is for the brass to have good machinability, good elevated temperature ductility and corrosion resistance.

It is a feature of the invention that a phosphorous addition within a specific range will provide elevated temperature ductility without reducing machinability. Yet another feature of the invention is that the addition of phosphorous or of tin to the alloy improves corrosion resistance. Surprisingly, a combination of phosphorous and tin provides superior corrosion resistance when compared to either addition alone.

Yet another advantage of the invention is that in addition to brass, the additives of the invention improve the machinability of other copper alloys such as bronze, nickel silver and beryllium copper.

It is a feature of the invention that the wrought alloy has machinability suitable for high speed machining. Yet another feature of the invention is that the alloy is hot workable due to the presence of a β phase and also has resistance to corrosion.

In accordance with the invention, there is provided a copper alloy. This copper alloy consists essentially of from about 30% to about 45% zinc, from about 1.5% to about 4.0% bismuth, from about 0.03% to about 0.09% phosphorous and the balance copper.

The above-stated objects, features and advantages will become more clear from the specification and drawings which follow.

DESCRIPTION OF THE INVENTION

Figure 1:
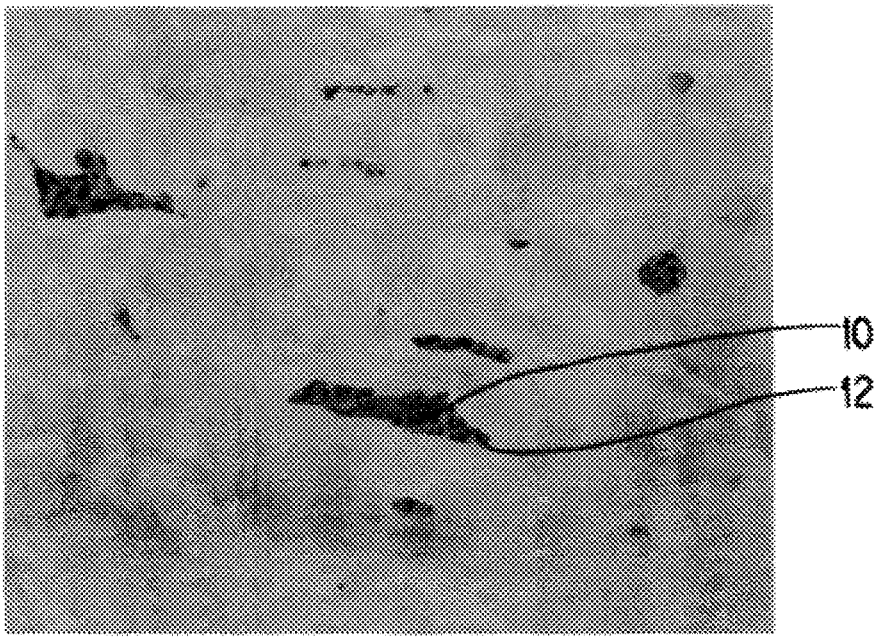
FIG. 1 is a photomicrograph showing the bismuth-lead eutectic.

Binary copper-zinc alloys containing from about 30% to about 45% zinc are called alpha-beta brass and, at room temperature, comprise a mixture of an alpha phase (a predominantly face centered cubic crystal structure) and a beta phase (a predominantly body centered crystal structure). The beta phase enhances hot processing capability but has poor cold processing capability. The alpha phase has better cold processability.

In potable water applications, the zinc concentration is preferably at the lower end of the alpha/beta range. The corresponding higher concentration of copper inhibits corrosion and the higher alpha content improves the performance of cold processing steps such as drawing and cold rolling. Preferably, the zinc concentration is from about 30% to about 45% zinc and most preferably, from about 32% to about 38% zinc. A copper alloy, such as brass, having alloying additions to improve machinability is referred to as a free machining alloy. The additions typically either reduce the resistance of the alloy to cutting or improve the useful life of a given tool. One such addition is lead. As described in U.S. Pat. No. 5,288,458, all or a portion of the lead may be substituted with bismuth.

Table 1 shows the effect on machinability of bismuth, lead, and bismuth/lead additions to brass. The brass used to obtain the values of Table 1 contained 36% zinc, the specified concentration of an additive and the balance copper. Machinability was determined by measuring the time for a 0.25 inch diameter drill bit under a load of 30 pounds to penetrate a test sample to a depth of 0.25 inches. The time required for the drill bit to penetrate alloy C353 (nominal composition 62% Cu, 36% Zn and 2% Pb) was given a standard rating of 90 which is consistent with standard machinability indexes for copper alloys. The machinability index value is defined as calculated from the inverse ratio of the drilling times for a fixed depth. That is, the ratio of the drilling time of alloy C353 to that of the subject alloy is set equal to the ratio of the machinability of the subject alloy to the defined machinability value of C353 (90).

$$\text{Machinability}_{(Subject\ Alloy)} = \frac{90 \times \text{Machining Time}_{C353}}{\text{Machining Time}_{(Subject)}} \quad 1$$

TABLE 1

| Index | Addition | Machinability |
|---|---|---|
| (C353) | 0.5% Pb | 60, 85* |
| | 1% Pb | 78, 83 |
| | 2% Pb | 90 (by definition) |
| | 3% Pb | 101, 106 |
| | 1% Bi | 83, 90 |
| | 2% Bi | 93, 97 |
| | 1% Pb–0.5% Bi | 85, 88 |
| | 1% Pb–1% Bi | 102, 120 |
| | 1% Pb–2% Bi | 100, 104 |

*Two samples of each alloy were tested, both calculated values recorded.

As illustrated in Table 1, increasing the bismuth concentration increases machinability. Preferably, the bismuth concentration is maintained below a maximum concentration of about 5 weight percent. Above 5% bismuth, processing is inferior and corrosion could become a problem. The minimum acceptable concentration of bismuth is that which is effective to improve the machinability of the copper alloy. More preferably, the bismuth concentration is from about 1.5% to about 5% and, most preferably, the bismuth concentration is from about 1.8% to about 3.0%.

Combinations of lead and bismuth gave an improvement larger than expected for the specified concentration of either lead or bismuth. In an embodiment of the invention, rather than the addition of a single element, combinations of elements are added to brass to improve machinability.

In one embodiment of the invention, the bismuth addition is combined with lead. This is advantageous because while decreased lead content is desirable for potable water, it would be expensive to scrap or refine all existing lead containing brass. The existing lead containing alloys may be used as feed stock in concert with additions of copper, zinc and bismuth to dilute the lead. When a combination of lead and bismuth is employed, the lead concentration is maintained at less than 2%. Preferably, the bismuth concentration is equal to or greater in weight percent than that of lead. Most preferably, as illustrated in Table 1, the bismuth-to-lead ratio by weight is about 1:1.

Phosphorous is detrimental to the machinability index of bismuth containing copper alloys. However, when present in an amount of less than about 0.09%, the addition of phosphorous can be tolerated. We have found that additions of tin ameliorate the detrimental effect of phosphorous. Even small amounts of tin, less than about 0.5% improve the drill machinability of a phosphorous containing bismuth brass. This is even more surprising in view of our observation that the addition of tin alone to a bismuth containing brass has a negative effect on drill machinability as shown in Table 2. The alloys of Table 2 contained nominally 2.5% bismuth, 35% zinc, the specified amount of phosphorous and tin and the balance copper.

TABLE 2

| % Phosphorous | % Tin | Average Drill Machinability Index |
|---|---|---|
| 0.0 | 0.0 | 98 |
| 0.031 | 0.0 | 77 |
| 0.045 | 0.0 | 78 |
| 0.0 | 0.184 | 87 |
| 0.0 | 0.437 | 81 |
| 0.034 | 0.21 | 79 |
| 0.056 | 0.49 | 89 |

At least some phosphorous must be present to provide the alloy with improved elevated temperature tensile elongation. Elevated temperature tensile elongation relates to the ductility of the alloy in the temperature range of about 200° C.

to about 350° C. The elevated temperature tensile elongation is a different property than resistance to fire-cracking. While fire-cracking resistance is important to prevent cracking when the alloy is heat for recrystallization, elevated temperature tensile elongation is critical to prevent cracking at lower temperatures, below about 350° C. These lower temperatures may be experienced when an extruded rod is cooling, when a hot worked strip is cooled or when friction heats a work piece during a machining operation such as drilling or knurling. The work piece may also be heated to the elevated temperature range during soldering.

Figure 5:
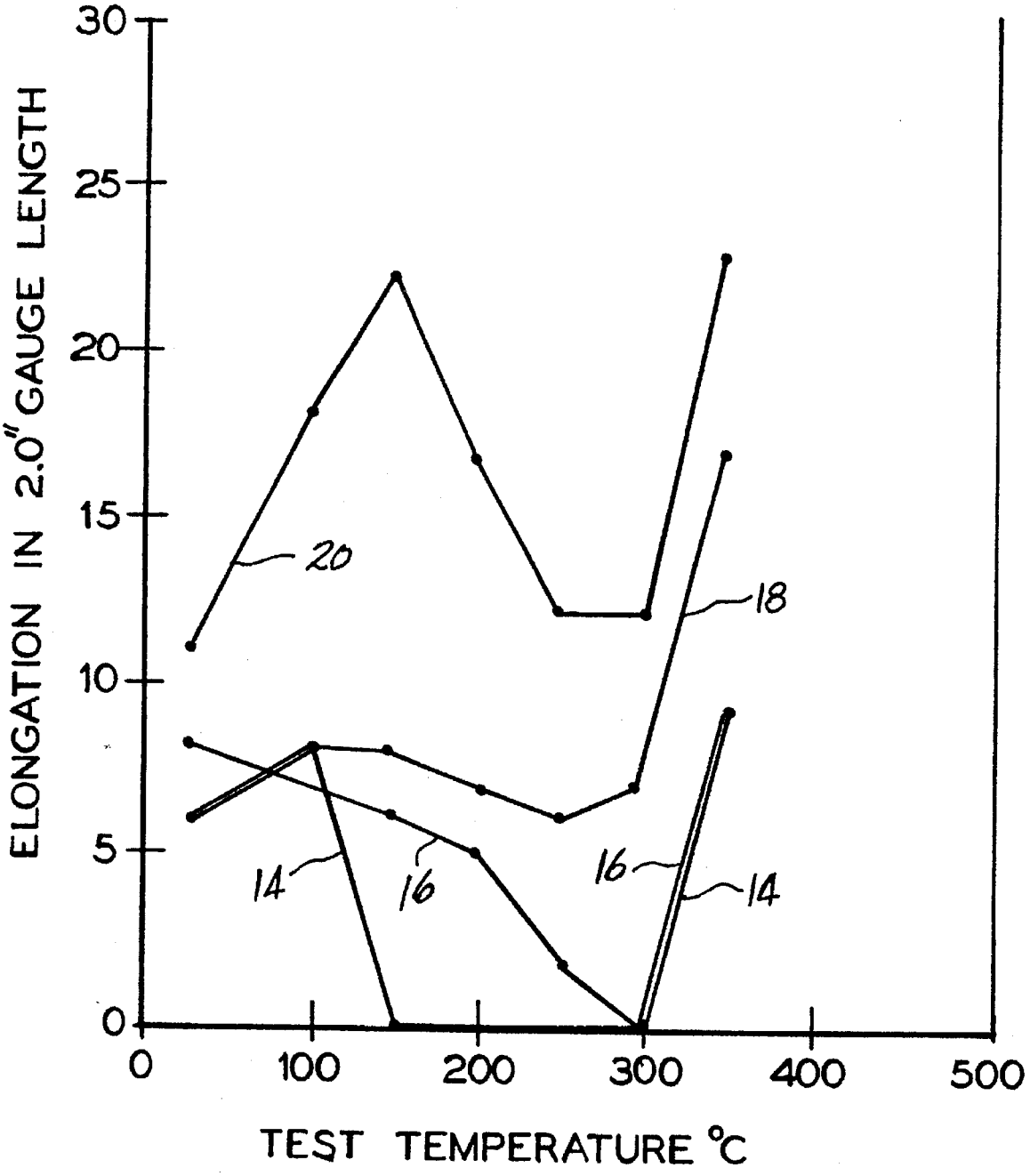
FIGS. 5 and 6 graphically illustrate the effect of phosphorous on the elevated temperature tensile elongation of bismuth containing brass.
Figure 6:
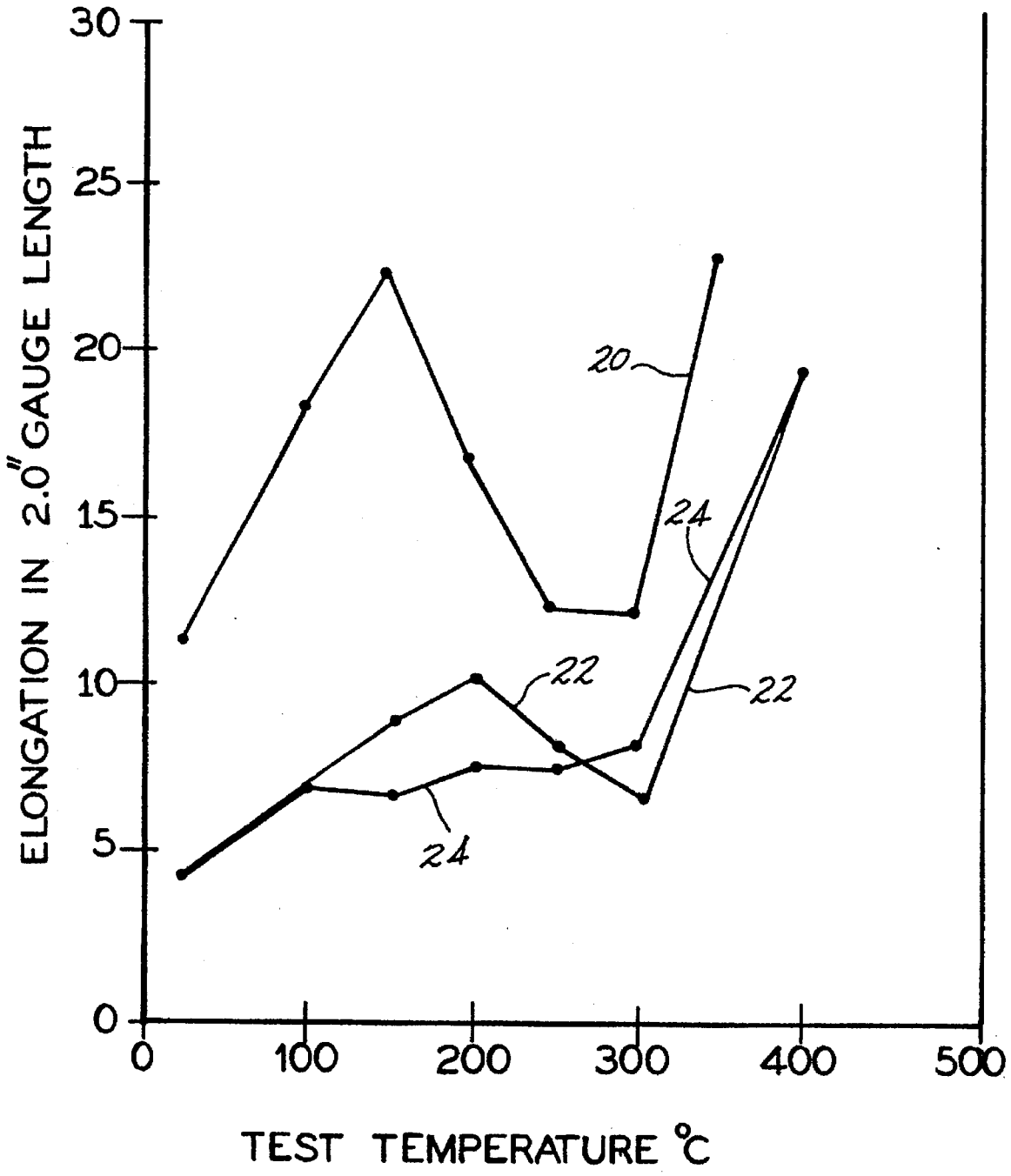
Figure 7:
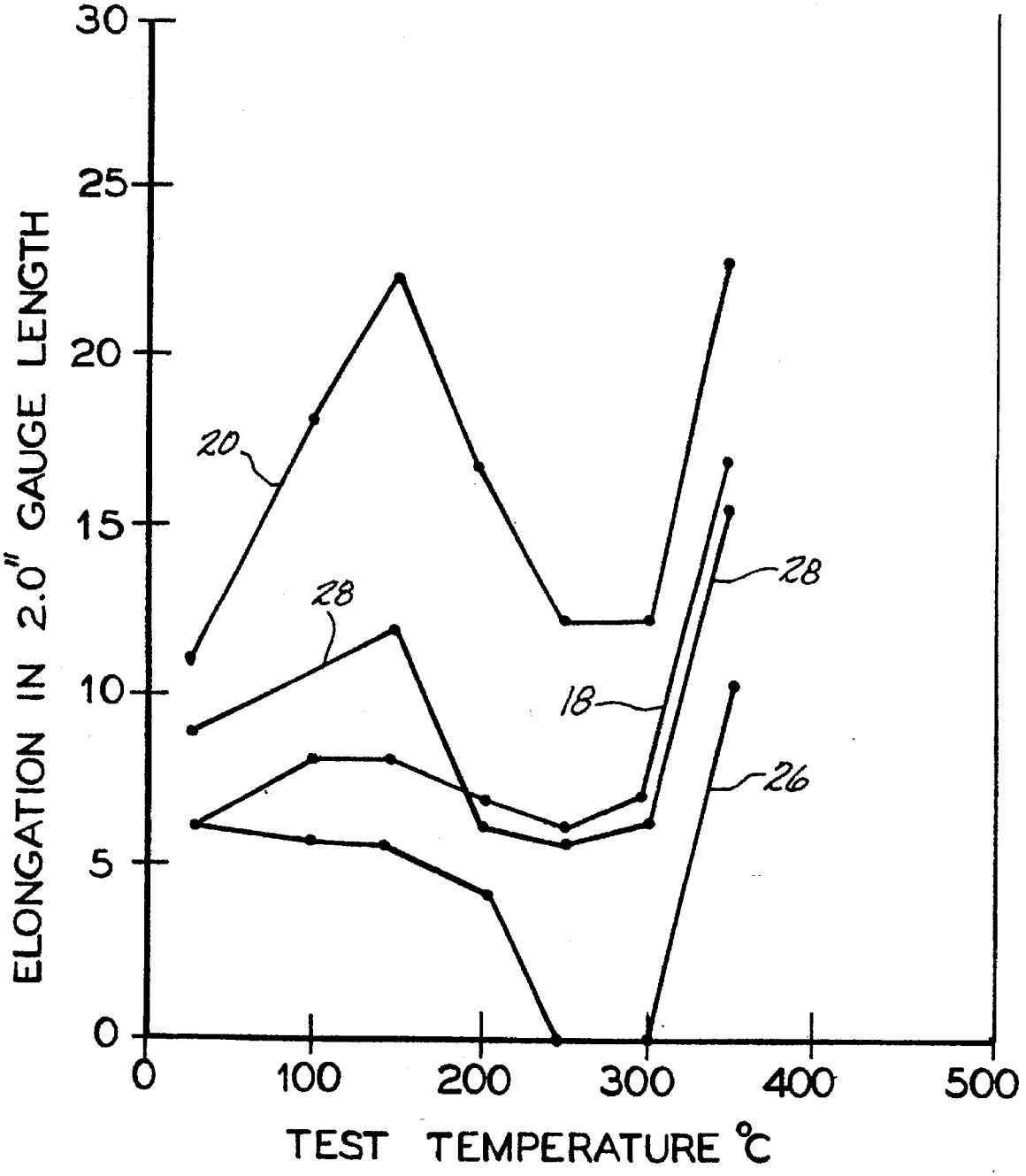
FIG. 7 graphically illustrates the effect on phosphorous plus an additional element on the elevated temperature tensile elongation of bismuth containing brass.

FIGS. 5, 6 and 7 illustrate the hot tensile elongation characteristics of an α+βbrass containing, nominally, 2.5% bismuth, 35.0% zinc, the specified additions and the balance copper.

Reference line 14=0% phosphorous
Reference line 16=0.009% phosphorous
Reference line 18=0.031% phosphorous
Reference line 20=0.045% phosphorous
Reference line 22=0.091% phosphorous
Reference line 24=0.14% phosphorous
Reference line 26=0.044% phosphorous
0.32% iron
Reference line 28=0.034% phosphorous
0.21% tin The bismuth containing α+β brass must have at least a minimum amount of hot tensile elongation, otherwise, extruded rods will fracture while cooling if handled roughly or even when struck in a routine manner by another rod coming from the extruder. Likewise, coiled rod may fracture when quenched or during machining or threading operations.

Each alloy was static cast as a 25.4 cm (10 inch) bar, heated to 760° C. and then extruded to a 4.2 cm diameter (1.64 dia.) rod. The elevated temperature tensile elongation coupons were prepared by repetitive cycles of about 50% thickness reductions by cold rolling followed by an anneal. The repetitions were repeated to a coupon thickness of about 0.015 cm (0.04 inch). The temper of the test coupons was 20% cold rolled.

The tensile test comprised elongating samples at a constant test speed of 2.5mm (0.1 inch) per minute until the sample fractured. The samples was held at various temperatures from room temperature (20° C.) to 350° C. for three minutes prior to beginning the elongation. The percent elongation to fracture as a function of temperature was then recorded.

Preferably, the alloy should have an elevated temperature tensile elongation over the temperature range of from about 100° C. to about 350° C. greater than or substantially equal to the room temperature tensile elongation of that alloy in the cold work temper. More preferably, the elevated temperature elongation over the temperature range of from about 200° C. to about 300° C. is about equal to the room temperature elongation of the alloy with a 10%–20% cold work temper. Cold work includes, but is not limited to, cold rolling and cold drawing.

Hot and cold working operations determine alloy temper. Generally, over the temperature range of from about 100° C. to about 350° C, the elevated temperature tensile elongation should be at least 5% by length. More preferably, the elevated temperature tensile elongation over the 100° C.–350° C. temperature range is at least 6% by length and most preferably in excess of about 8%, by length.

As shown in FIGS. 5 and 6, to achieve the improved ductility represented by these elevated temperature tensile elongation values as well as satisfactory machinability, the phosphorous content should be at least about 0.03%, by weight, and not more than about 0.09%, by weight. Higher phosphorous contents lead to the formation of numerous phosphide inclusions. These inclusions are much harder than the alloy matrix and rapidly dull the machining tool. The preferred phosphorous content is from about 0.04% to about 0.09% and the most preferred phosphorous content from about 0.045% to about 0.07%.

FIG. 6 graphically illustrates that there is a maximum acceptable phosphorous content of about 0.09%. When the phosphorous content approaches this critical maximum, the elevated temperature tensile elongation decreases. Compare reference line 22 (0,091% phosphorous) with reference line 20 (0,045% phosphorous). The elevated temperature tensile elongation is further depressed when the phosphorous content is increase to 0.14% as illustrated by reference line 24.

As graphically illustrated in FIG. 7, the elevated temperature tensile elongation is dependent of the constituents of the alloy. Phosphide forming additions, such as iron, nickel, manganese and chromium, are detrimental (compare reference line 26 with reference line 20) and should not be present in higher than impurity levels, about 0.15%, each. Preferably, each impurity is present in an amount of less than about 0.1%. Non-phosphide forming additions, such as tin, are not so detrimental (compare reference line 28 with reference line 18) and may be present in a desired quantity to influence other properties such as corrosion resistance.

FIG. 1 shows a photomicrograph of the brass sample of Table 1 having a 1%Pb–2%Bi addition. The sample was prepared by standard metallographic techniques. At a magnification of 1000×, the presence of a eutectic phase 10 within the bismuth alloy 12 is visible. The formation of a dual phase particle leads to the development of an entire group of alloy additions which should improve the machinability of brass.

The presence of a Pb—Bi eutectic region within the grain structure improves machinability. The cutting tool elevates the temperature at the point of contact. Melting of the Pb—Bi lubricates the point of contact decreasing tool wear. Additionally, the Pb—Bi region creates stress points which increase breakup of the alloy by chip fracture.

Table 3 illustrates the eutectic compositions and melting points of bismuth containing alloys which may be formed in copper alloys. It will be noted that the melting temperature of several of the eutectics is below the melting temperature of either lead, 327° C, or bismuth, 271° C.

TABLE 3

| Bi-X System | Eutectic Melting Point | Weight % Bismuth |
|---|---|---|
| Bi—Pb | 125° C. | 56.5 |
| Bi—Cd | 144° C. | 60 |
| Bi—Sn | 139° C. | 57 |
| Bi—In | 72° C. | 34 |
| Bi—Mg | 551° C. | 58.9 |
| Bi—Te | 413° C. | 85 |

In some embodiments, is desirable to maximize the amount of eutectic constituent in the second phase particle. The Bi—addition is selected so the nominal composition of the particle is at least about 50% of the eutectic. More preferably, at least about 90% of the particle is eutectic. By varying from the eutectic composition in a form such that the lower melting constituent is present in an excess, the machinability is further improved.

In addition to binary eutectics, ternary eutectics and higher alloy systems are also within the scope of the invention.

While the addition of bismuth to improve machinability has been particularly described in combination with brass, the machinability of other copper based matrices is also improved by the additions of the invention. Among the other matrices improved are copper-tin, copper-beryllium, copper-manganese, copper-zinc-aluminum, copper-zinc-nickel, copper-aluminum-iron, copper-aluminum-silicon, copper-manganese-silicon, copper-zinc-tin, copper-zinc-silicon and copper-manganese-zinc. Other leaded copper alloys such as C544 (nominal composition by weight 89% copper, 4% lead, 4% tin and 3% zinc) may be made with a lower lead concentration by the addition of bismuth.

The effect of bismuth on machinability also occurs in alpha/beta brass having a portion of the copper, zinc or both matrix elements partially replaced. Suitable replacements are one or more metallic elements which substitute for the copper or zinc in the alloy matrix. Preferred zinc substitutes include aluminum, tin and silicon and preferred copper substitutes include nickel, manganese and iron.

Figure 2:
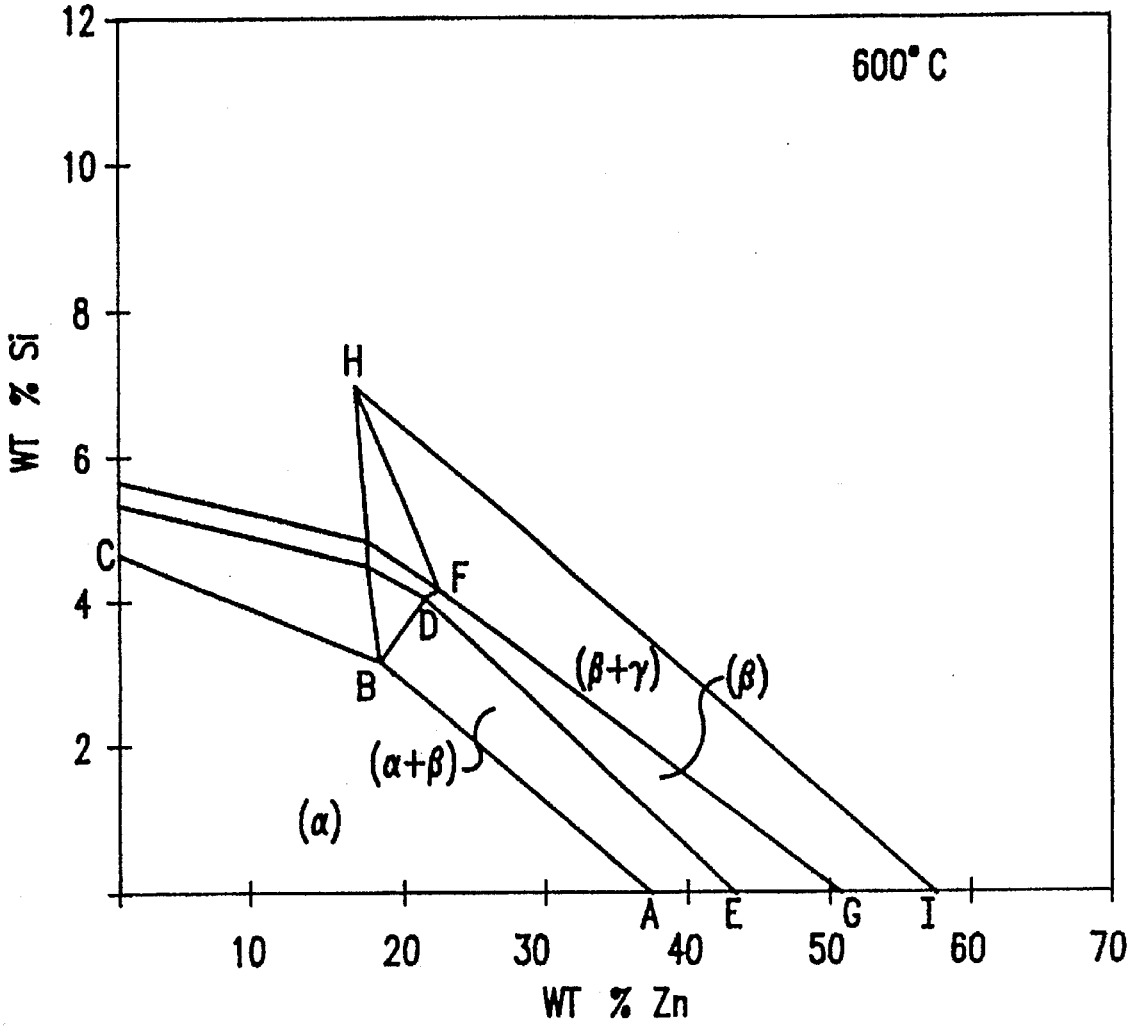
FIG. 2 illustrates a portion of the Cu—Si—Zn phase diagram defining the alpha/beta region.

When a portion of the zinc is replaced, the amount of zinc substitute and the ratio of zinc to zinc substitute is governed by the phase transformations of the alloy. At hot working temperatures, typically around 600° C. or above, sufficient beta phase should be present to minimize hot shortness. At room temperature, the amount of beta phase is intentionally minimized for improved cold ductility. The appropriate zinc and zinc substitute composition is determined from the ternary phase diagram. FIG. 2 illustrates the relevant portion of the copper-silicon-zinc ternary phase diagram at 600° C. The composition region delineated by the specified points is temperature dependent. Silicon as a replacement for zinc increases the strength of the alloy. The alpha phase region is bordered by line ABC and the axes. The composition region for a mixture of alpha and beta is delineated by ABDE. The predominantly beta region is defined by EDFG. A beta plus gamma region is defined by GFHI. The presence of bismuth, lead, and the other machinability improving additions is considered to be inert in determining the constitution of the brass matrix. The phase diagram illustrates the percentage of zinc and the zinc replacement necessary to be in the alpha/beta regime at 600° C, for example. Sufficient copper is present to achieve 100 weight percent. The bismuth, lead or other addition is added as a subsequent addition and not part of the mathematical calculations.

For hot working, the weight percent of zinc and silicon is that defined by the beta rich region defined by ABHI. The broadest composition range of the copper-zinc-silicon-bismuth alloys of the invention have a zinc and silicon weight percent defined by ABHI and sufficient copper to obtain a weight percent of 100%. Bismuth is then added to the alloy matrix in an amount of from that effective to improve machinability up to about 5%.

While a high concentration of beta is useful for hot working the alloys, a predominantly alpha phase is required for cold workability. The preferred zinc and silicon content is defined by the region ABFG and the most preferred content by the region ABDE.

Figure 3:
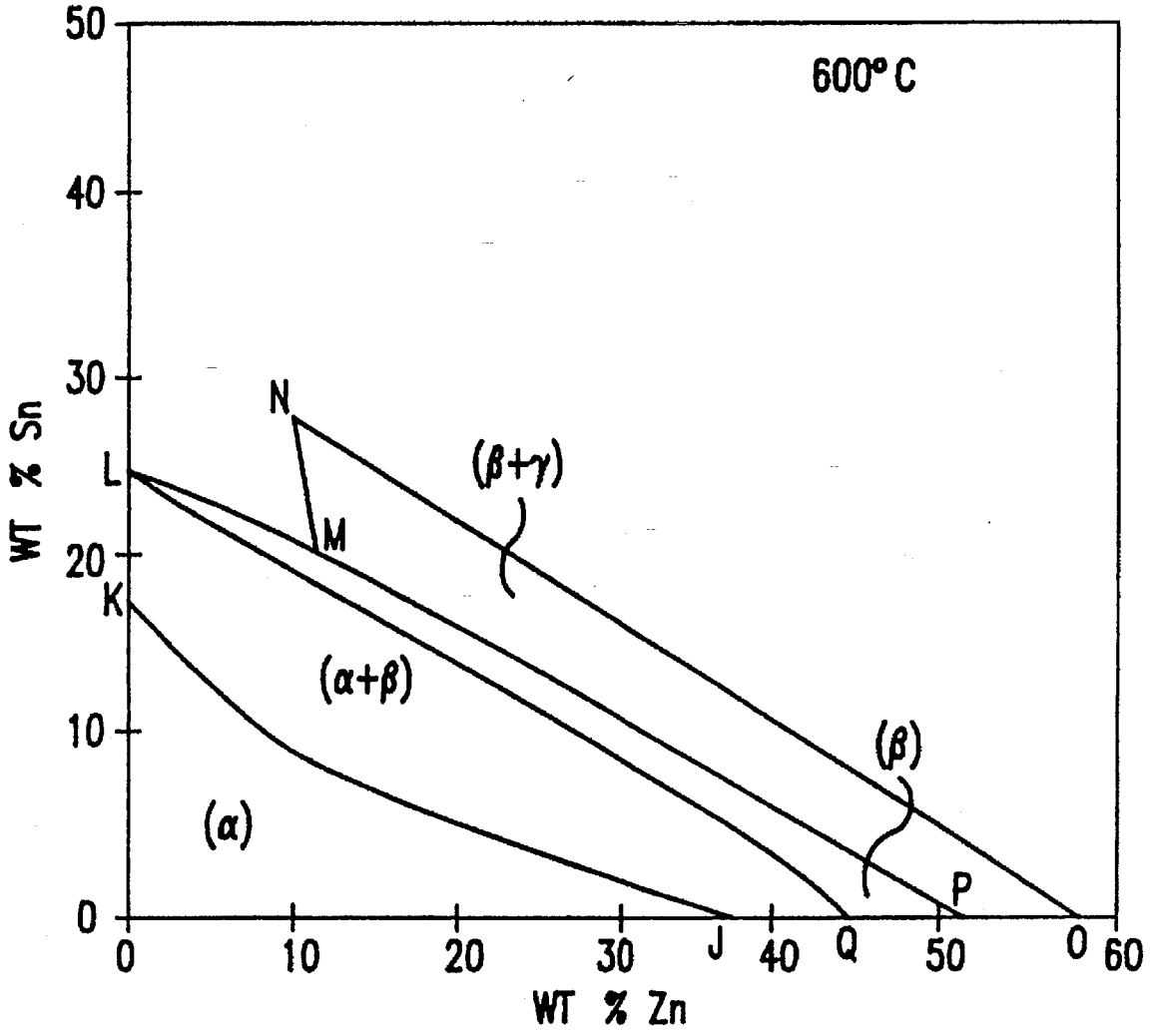
FIG. 3 illustrates a portion of the Cu—Sn—Zn phase diagram defining the alpha/beta region.

When a portion of the zinc is replaced by tin, the alloy is characterized by improved corrosion resistance. The composition ranges of tin and zinc are defined by the 600° C. phase diagram illustrated in FIG. 3. The bismuth containing $\alpha+\beta$ brass contains from about 0.1% to about 5% tin. Preferably, the tin content is from about 0.5% to about 3.0% and most preferably from about 0.7% to about 1.5%. Surprisingly, while both tin and phosphorous improve the corrosion resistance of an $\alpha+\beta$ bismuth brass, the combination of phosphorous and tin provides a larger than expected improvement.

Additions to the $\alpha+\beta$bismuth brass of the invention to impart superior corrosion resistance are:

0.001%–0.09% P +0.1%–5.0% Sn 0.03%–0.09% P +0.5%–3% Sn 0.045%–0.07% P +0.7%–1.5% Sn.

A portion or all of the phosphorous may be replaced with arsenic. However, arsenic is less preferred for environmental reasons and because the corrosion resistance is not quite as good as the combination of tin and phosphorous.

Figure 4:
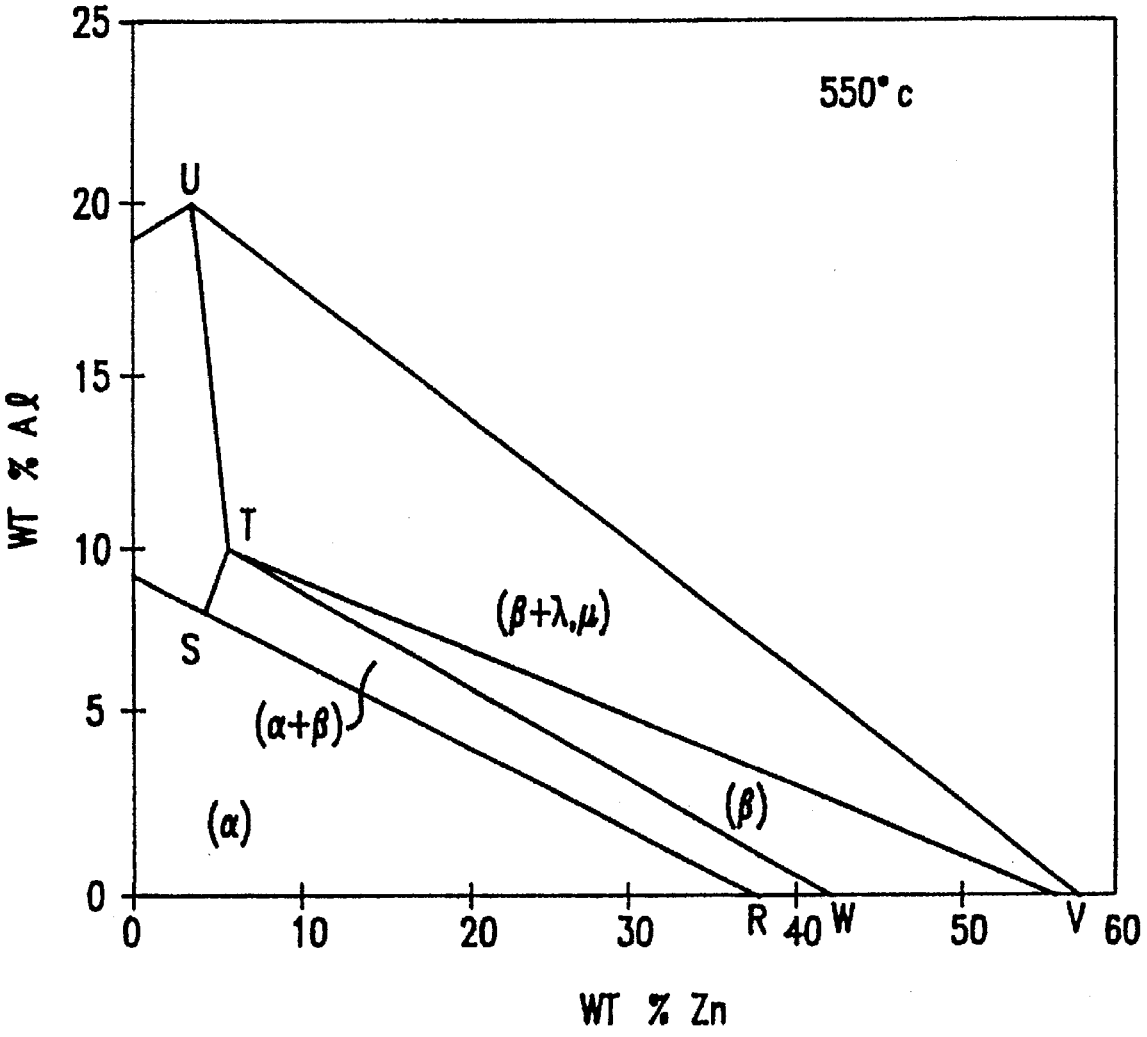
FIG. 4 illustrates a portion of the Cu—A1—Zn phase diagram defining the alpha/beta region.

FIG. 4 illustrates the phase diagram at 550° C. for the Cu—Zn—A1 ternary alloy that illustrates how a portion of the zinc can be replaced with aluminum. The substitution of zinc with aluminum provides the alloy with both improved corrosion resistance and a slight increase in strength. The broad composition range of zinc and aluminum is established by the region RSTUV. The more preferred range is defined by the region RSTV and the most preferred range by the region RSTW.

Other elemental additions replace a portion of the copper rather than the zinc. These substitutions include nickel which can be added for cosmetic reasons. The nickel gives the alloy a whiter color, the so called "nickel silvers" or "German silvers". Iron or manganese provide the alloy with a slight increase in strength and permit the use of larger quantities of scrap in casting the melt, reducing cost. From about a trace up to 4% by weight of either iron or manganese or mixtures thereof may be added to the alpha/beta brass as a 1:1 replacement for copper. A more preferred concentration of iron, manganese or a mixture thereof is from about 0.5% to about 1.5%. Subsequent to calculating the replacement addition, bismuth is added in an amount from that effective to improve machinability up to about 5%. The more preferred concentration of iron or manganese is from about 0.5 to about 2%. While the preferred bismuth range is from about 1.8 to 3%.

Nickel may be added in the range of from a trace to about 25% as a 1:1 replacement for copper. The preferred nickel range is from about 8% to 18%. The bismuth range is similar to that utilized in the iron and manganese replaced alloys.

Mixtures of nickel and manganese can also replace some or all of the zinc. One such an alloy is disclosed in U.S. Pat. No. 3,772,092 to Shapiro et al., as containing 12.5%–30% nickel, 12.5%–30% manganese, 0.1%–3.5% zinc and the balance copper. Other additions such as 0.01%–5% magnesium, 0.001%–0.1% boron or 0.01%–5% aluminum may also be present.

While the disclosed alloys are predominantly quaternary, it is within the scope of the invention to further include any additional unspecified additions to the alloy which impart desirable properties. The addition need not be metallic, and may take the form of a particle uniformly dispersed throughout the alloy.

The bismuth, lead or other machinability aid added to the brass matrix can take the form of discrete particles or a grain boundary film. Discrete particles uniformly dispersed throughout the matrix are preferred over a film. A film leads to processing difficulties and a poor machined surface finish.

A spheroidizing agent can be added to encourage the particle to become more equiaxed. The spheroidizing agent is present in a concentration of from an effective amount up to about 2 weight percent. An effective amount of a spheroidizing agent is that which changes the surface energy or wetting angle of the second phase. Among the preferred spheroidizers are phosphorous, antimony and tin. The spheroidizing agents may be added to either bismuth or any of the eutectic compositions disclosed in Table 3 above. A more preferred concentration is from about 0.1% to about 1%.

In copper alloys other than brasses, for example alloy C725 (nominal composition by weight 88.2% Cu, 9.5% Ni, 2.3% Sn), zinc may be added to spheroidize a free machining additive. The zinc is present in an effective concentration up to about 25% by weight.

A sulfide, telluride or selenide may be added to the copper matrix to improve machinability. The addition is present in a concentration effective to improve machinability up to about 2%. More preferably, the concentration is from about 0.1% to about 1.0%. To further enhance the formation of sulfides, tellurides and selenides over the amount obtained with elemental copper, an element which combines with these latter three such as zirconium, manganese, magnesium, iron, nickel or mischmetal may be added.

Alternatively, copper oxide particulate in a concentration of up to about 10% by weight may be added to the matrix to improve machinability.

When brass is machined, the tool deteriorates over time due to wear. One method of improving tool life is to provide an addition to the alloy which lubricates the tool minimizing wear. Preferred tool coating additions include calcium aluminate, calcium aluminum silicate and magnesium aluminum silicate, graphite, talc, molybdenum disulfide and hexagonal boron nitride. The essentially lead-free additive is preferably present in a concentration of from about 0.05% percent by weight to about 2%. More preferably, the additive is present in a concentration of from about 0.1% to about 1.0%.

Some of the coating elements which improve cutting are not readily cast from the melt. A fine distribution of particles may be achieved by spray casting the desired alloy. A liquid stream of the desired alloy, or more preferably, two streams (one of which may be solid particles), for example, brass as a first stream and calcium silicate as a second stream, are atomized by impingement with a gas. The atomized particles strike a collecting surface while in the semisolid form. The semisolid particles break up on impact with the collecting surface, forming a coherent alloy. The use of two adjacent streams with overlapping cones of atomized particles forms a copper alloy having a second phase component which generally cannot be formed by conventional casting methods.

The advantages of the α+βbismuth brass of the invention will be more apparent from the example which follows. The example is exemplary and not intended to limit the scope of the invention.

EXAMPLE

A series of high (1.4%–2.0%) bismuth content α+βbrasses having the compositions indicated in Table 4 were Durville cast and then extruded into rods. The rods were then machined into discs having a diameter of 0.5 inch and a thickness of 0.25 inch. A threaded hole was formed in the discs and the discs threaded onto copper alloy C110 rods. The threaded copper rod to disc joint forms a crevice where corrosion is intensified. The threaded rod/disc assemblies were then immersed in an aggressive water solution for a period of 4 weeks at a temperature of 85° C. with 25% of the water being changed daily, except for weekends.

The aggressive water simulates natural lime softened tap water from Hanningfield Water Works (England) where dezincification is prevalent and is a standard severe water solution used to evaluate corrosion.

The aggressive water make up was:

10 liters—distilled water 1.5 grams sodium sulfate 1.1 grams sodium chloride 0.5 grams magnesium sulfate 1.1 grams calcium carbonate 0.75 grams sodium nitrate The solution was vigorously stirred and carbon dioxide bubbled through it to promote dissolution of the salts. Air was then bubbled through the solution to raise the pH to a minimum of 8.3.

After the four week exposure to the aggressive water, the discs were mounted in an electrically non-conductive epoxy, metallographically polished, cross sectioned and the depth of corrosion metallographically measured. These results are presented in Table 5.

TABLE 4

| | Composition (balance copper) | | | |
|---|---|---|---|---|
| Sample | % zinc | % bismuth | % addition | % β phase |
| 2 | 35.9 | 1.73 | 0.26 As | 15 |
| 3 | 36.6 | 1.79 | 0.53 As | 25.7 |
| 4 | 36.2 | 1.58 | 0.039 P | 24.5 |
| 5 | 36.3 | 1.72 | 0.03 Sb | 32.8 |
| 7 | 36.6 | 1.63 | 0.05 In | 28.7 |
| 8 | 36.1 | 1.57 | 0.58 Sn | 19.3 |
| 9 | 36.4 | 1.40 | 1.1 Sn | N.M.★ |
| 10 | 37.2 | 1.47 | 0.99 Ni | 22.7 |
| 11 | 36.1 | 1.41 | 1.1 Sn/ 0.44 P | 22.9 |
| 12 | 36.1 | 1.45 | 1.1 Sn/ 0.048 As | 28.4 |
| 13 | 36.8 | 1.54 | 0.60 Ni/ 0.35 Mn | 20.1 |
| 14 | 36.7 | 1.51 | 0.07 Sb/ 0.06 P | N.M. |
| 15 | 36.1 | 1.46 | 1.16 Sn 0.08 Sb | 19.5 |
| 16 | 35.2 | 1.9 | 0 | 17.4 |
| 17 | 35.3 | 1.9 | 0.06 Sb | 23.8 |

★N.M. = not measured

TABLE 5

| | Depth and Type★ of Corrosive Attack | | |
|---|---|---|---|
| Sample | Maximum Depth mils | Average Depth mils | Type |
| 2 | 10.2 | 7.7 | I.G. |
| 3 | 28.7 | 23.0 | I.G. |
| 4 | 9.4 | 7.6 | I.G. |
| 5 | 48.0 | 36.9 | Layer/I.G. |
| 7 | 23.6 | 19.2 | Layer |
| 8 | 16.5 | 14.8 | Plug/Layer |
| 9 | N.M. | N.M. | N.M. |
| 10 | 20.5 | 16.9 | Layer/Plug |
| 11 | 1.7 | 1.1 | I.G. |
| 12 | 1.5 | 0.8 | I.G. |
| 13 | 12.4 | 10.1 | Layer/I.G. |
| 14 | N.M. | N.M. | N.M. |
| 15 | 12.8 | 11.3 | Plug/I.G. |
| 16 | 22.0 | 19.9 | Layer |
| 17 | 15.7 | 12.2 | I.G. |

★Types of corrosion:
Plug - preferential corrosion of the β phase.
I.G. - intergranular corrosion, occurs preferentially at grain boundaries with slight or negligible attack of the adjacent grains.
Layer - uniform attack of α and β phase.

A second group of samples, having the same compositions as identified in Table 4 were heated to 450° C. for one hour to reduce the beta content. As shown in Table 6, the best results were again obtained when the additive is a combination of tin and phosphorous or tin and arsenic. Unlike the iron-type transition metals, tin does not form a phosphide.

As discussed above, the presence of phosphides is detrimental to machinability.

TABLE 6

| Sample | Depth and Type of Corrosion: Maximum Depth mils | Average Depth mils | Type |
|---|---|---|---|
| 2 | 10.6 | 7.0 | I.G. |
| 3 | 24.3 | 16.6 | I.G. |
| 4 | 9.5 | 7.0 | I.G. |
| 5 | 26.0 | 20.4 | Layer/I.G. |
| 7 | N.M. | N.M. | N.M. |
| 8 | 15.9 | 14.5 | Layer |
| 9 | 15.2 | 13.1 | Layer/Plug |
| 10 | 15.2 | 13.4 | Plug/ |
| 11 | 7.5 | 7.0 | I.G. |
| 12 | 2.5 | 2.0 | I.G. |
| 13 | 17.2 | 15.6 | Layer/I.G./ Plug |
| 14 | 15.8 | 12.1 | I.G. |
| 15 | 10.0 | 8.4 | I.G. |
| 16 | 18.0 | 16.2 | Layer/I.G. |
| 17 | 13.0 | 10.0 | I.G. |

From Tables 5 and 6, it is determined that the best corrosion resistance for a bismuth containing $\alpha+\beta$ brass is provided by additions of phosphorous, tin or arsenic. A synergistic result is achieved by mixtures of tin and one of the other two additions.

While the invention has been described in terms of plumbing fixtures, other machinable brass products also benefit from a reduced lead content. Such products include key stock and heat exchanger components such as a tube sheet.

The patents and publication set forth in the application are intended to be incorporated herein by reference.

It is apparent that there has been provided in accordance with this invention, a bismuth containing brass having improved machinability, corrosion resistance and high temperature elongation that fully satisfies the objects, means and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A copper alloy, consisting essentially of, by weight:

from about 30% to about 45% zinc;

from about 1.5% to about 5.0% bismuth;

from about 0.03% to a maximum of 0.09% phosphorous; and the balance copper.

2. The copper alloy of claim 1 wherein said phosphorous content is from about 0.04% to about 0.09%.

3. The copper alloy of claim 2 wherein said phosphorous content is from about 0.045% to about 0.07%.

4. The copper alloy of claim 1 further containing from about 0.1% to about 5.0% tin.

5. The copper alloy of claim 2 further containing from about 0.5% to about 3.0% tin.

6. The copper alloy of claim 3 further containing from about 0.7% to about 1.5% tin.

7. The copper alloy of claim 1 wherein at least a portion of said phosphorous is substituted with an equivalent amount of arsenic.

8. The copper alloy of claim 4 wherein at least a portion of said phosphorous is substituted with an equivalent amount of arsenic.

9. A copper alloy work piece, consisting essentially of, by weight:

from about 30% to about 45% zinc;

from about 1.5% to about 5.0% bismuth;

an amount of phosphorous effective to provide the work piece with an elevated temperature tensile elongation greater than or substantially equal to the room temperature tensile elongation of a cold work temper work piece over a temperature range of from about 100° C. to about 350° C. up to a maximum of about 0.09% phosphorous; and the balance copper.

10. The copper alloy work piece of claim 9 wherein said elevated temperature tensile elongation is greater than or substantially equal to said room temperature tensile elongation of a cold work temper work piece over a temperature range of from about 200° C. to about 300° C.

11. The copper alloy work piece of claim 10 further containing from about 0.5% to about 3.0% tin.

12. The copper alloy work piece of claim 11 wherein said tin content is from about 0.7% to about 1.5%.

13. The copper alloy work piece, consisting essentially of, by weight:

from about 30% to about 45% zinc;

from about 1.5% to about 5.0% bismuth;

an amount of phosphorous effective to provide the work piece with an elevated temperature tensile elongation of at least 5% by length over a temperature range of from about 100° C. to about 350° C. up to a maximum of 0.09% phosphorous; and the balance copper.

14. The copper alloy work piece of claim 13 wherein said elevated temperature tensile elongation is at least about 6%.

15. The copper alloy work piece of claim 14 wherein said elevated temperature tensile elongation is at least about 8%.

16. The copper alloy work piece of claim 13 wherein said elevated temperature tensile elongation is at least about 6% over a temperature range of from about 200° C. to about 300° C.

17. The plumbing fixture comprising:

a rod exhibiting resistance to corrosion in water containing threads or crevices and formed from a copper alloy consisting essentially of, by weight:

from about 30% to about 45% zinc;

from about 1.5% to about 5.0% bismuth;

from about 0.03% to a maximum of 0.09% phosphorous; and the balance copper.

18. The plumbing fixture of claim 17 wherein said phosphorous content is from about 0.04% to about 0.09%.

19. The plumbing fixture of claim 18 wherein said phosphorous content is from about 0.045% to about 0.07%.

20. The plumbing fixture of claim 18 further containing from about 0.5% to about 3.0% tin.

21. The plumbing fixture of claim 20 further containing from about 0.7% to about 1.5% tin.

22. The work piece of claim 13 formed into key stock.

23. The work piece of claim 13 formed into a heat exchanger component.

* * * * *